US006957679B2

(12) United States Patent
Powell et al.

(10) Patent No.: US 6,957,679 B2
(45) Date of Patent: Oct. 25, 2005

(54) RETRACTABLE AWNING

(75) Inventors: Billy R. Powell, Lillington, NC (US); Tony A. Powell, Fuguay-Varina, NC (US); Reid Powell, Lillington, NC (US)

(73) Assignee: Powell & Powell Supply Co., Inc., Lillington, NC (US)

( * ) Notice: Subject to any disclaimer, the term of this patent is extended or adjusted under 35 U.S.C. 154(b) by 67 days.

(21) Appl. No.: 10/397,944

(22) Filed: Mar. 26, 2003

(65) Prior Publication Data

US 2004/0188034 A1 Sep. 30, 2004

(51) Int. Cl.[7] ..... E04F 10/06
(52) U.S. Cl. ..... 160/64; 160/70; 160/263
(58) Field of Search ..... 160/22, 66, 67, 160/62, 64, 70, 71, 60, 263, 405; 135/88.11, 135/88.12

(56) References Cited

U.S. PATENT DOCUMENTS 615,174 A * 11/1898 Hettrick ..... 160/64
827,483 A * 7/1906 Voorhees ..... 160/21
1,099,258 A * 6/1914 Koziell ..... 160/263
1,363,746 A * 12/1920 Nossek ..... 160/263
1,691,969 A * 11/1928 Glover ..... 160/47
1,724,606 A * 8/1929 Lewis ..... 160/49
1,834,669 A * 12/1931 Yeates ..... 160/263
2,620,025 A * 12/1952 Powers ..... 160/64
3,612,145 A 10/1971 Darula et al.
3,789,904 A * 2/1974 Takazawa ..... 160/120
3,991,805 A 11/1976 Clauss
4,020,888 A 5/1977 Upton et al.
4,033,397 A 7/1977 McKee
4,117,876 A 10/1978 Bennett
4,164,972 A 8/1979 Bennett
4,171,013 A 10/1979 Clark
4,198,998 A 4/1980 Duffy
4,214,621 A * 7/1980 Wessels et al. ..... 160/66
RE30,664 E 7/1981 Upton et al.
4,422,491 A 12/1983 Cusick, III
4,508,126 A 4/1985 Everard
4,530,389 A 7/1985 Quinn et al.
4,658,877 A 4/1987 Quinn
4,694,876 A * 9/1987 Bottom ..... 160/45
4,724,882 A 2/1988 Wang
4,733,683 A 3/1988 Pozzi
4,754,774 A 7/1988 Leader
4,759,396 A 7/1988 Quinn
4,819,706 A 4/1989 Quinn
4,819,707 A 4/1989 Watson et al.
4,997,021 A 3/1991 Brutsaert
5,171,056 A 12/1992 Faludy et al.
5,172,743 A 12/1992 Wallace et al.
5,174,352 A 12/1992 Murray et al.
5,269,359 A 12/1993 Pozzi (Continued)

*Primary Examiner*—David Purol
(74) *Attorney, Agent, or Firm*—Coats & Bennett, P.L.L.C.

(57) ABSTRACT

A retractable awning includes a frame structure, roll bar, and a lead bar supported in cantilever fashion by a series of extendable arms that extend from the frame structure. An awning sheet is connected between the roll bar and the lead bar. When the lead bar is extended outwardly from the roll bar, the sheet awning is unrolled and supplied from the roll bar. Conversely, when the awning is retracted, the lead bar retracts towards the roll bar and in the process, the sheet awning is rolled onto the roll bar. The frame structure, roll bar and lead bar are split into at least two sections with each pair of sections including a coupler for connecting the two sections together.

39 Claims, 8 Drawing Sheets

U.S. PATENT DOCUMENTS 5,307,855 A 5/1994 Martensson, IV
5,307,856 A 5/1994 Murray
5,381,844 A 1/1995 Struben
5,449,032 A 9/1995 Blevins et al.
5,549,129 A 8/1996 Becker
5,558,145 A 9/1996 Baka
5,560,412 A 10/1996 Murray
5,592,982 A 1/1997 Murray et al.
5,595,204 A * 1/1997 Hwang ..... 135/142
5,611,380 A 3/1997 Landy
5,732,756 A 3/1998 Malott
5,860,440 A 1/1999 Murray et al.
5,924,465 A 7/1999 Malott
5,927,363 A 7/1999 Olsen
5,944,085 A 8/1999 Malott
6,021,834 A 2/2000 Malott
6,021,835 A 2/2000 Malott
6,024,153 A 2/2000 Goldman
6,123,136 A 9/2000 Williams
6,152,516 A 11/2000 Williams
6,260,908 B1 7/2001 Fraula et al.
6,267,130 B1 7/2001 Konda
6,315,025 B1 * 11/2001 Mabie ..... 160/22
6,341,638 B1 1/2002 Thompson et al.
RE37,567 E 3/2002 Murray
6,378,591 B1 4/2002 McCoy
6,457,508 B1 10/2002 Tomita
6,460,593 B1 10/2002 Floyd
6,484,069 B2 11/2002 Osinga
6,494,246 B1 12/2002 Blevins

* cited by examiner

RETRACTABLE AWNING

FIELD OF THE INVENTION

The present invention relates to awnings and more particularly to a retractable awning that is specifically designed to accommodate shipping and merchandising.

BACKGROUND OF THE INVENTION

Many awning structures sold in the United States today are custom manufactured. These custom manufactured awnings are often manufactured and sold by local awning shops. In addition to custom manufactured awnings, there are businesses that manufacture and sell standard awnings including retractable awnings. However, these non-customized awnings are usually sold through mail order and the internet, and are not ordinarily found in conventional retail settings.

Awnings, and particularly retractable awnings, are long and in many cases have a length of 16 feet or longer. That makes awnings in general ungainful and difficult to handle. They are also awkward to package and shipping is relatively expensive. Because of their length, awnings are particularly susceptible to damage during shipment. Because of these factors and considerations, little effort has been made to sell and merchandise awnings in traditional retail outlets.

SUMMARY OF THE INVENTION

The present invention relates to a retractable awning having a frame structure, a roll bar, and a lead bar, wherein all three of these components are split or divided into two sections. To couple the sections together, there is provided a series of couplers for coupling the frame structure and the lead bar sections.

In one embodiment, the coupler coupling the roll bar sections together is provided with a drive member extending from section into engagement with the other section. Since at least one of the roll bar sections is driven, it follows that by driving one section that the other section is likewise driven.

The present invention also entails a method of manufacturing a retractable awning and a method of assembling a retractable awning. In this case, the retractable awning is manufactured in sections and more particularly, the main-frame structure, roll bar, and lead bar are each manufactured in at least two separate sections. The method of manufacture further includes providing a coupler for coupling together the sections of the frame structure, roll bar and lead bar.

Likewise, the method of assembling the retractable awning of the present invention includes coupling together the sections of the frame structure, roll bar and lead bar. In coupling the roll bar sections together, a drive member is extended from one roll bar section into engagement with another roll bar section such that when one roll bar section is driven, the other roll bar section is likewise driven.

Other objects and advantages of the present invention will become apparent and obvious from a study of the following description and the accompanying drawings, which are merely illustrative of such invention.

DESCRIPTION OF EXEMPLARY EMBODIMENT

Figure 1:
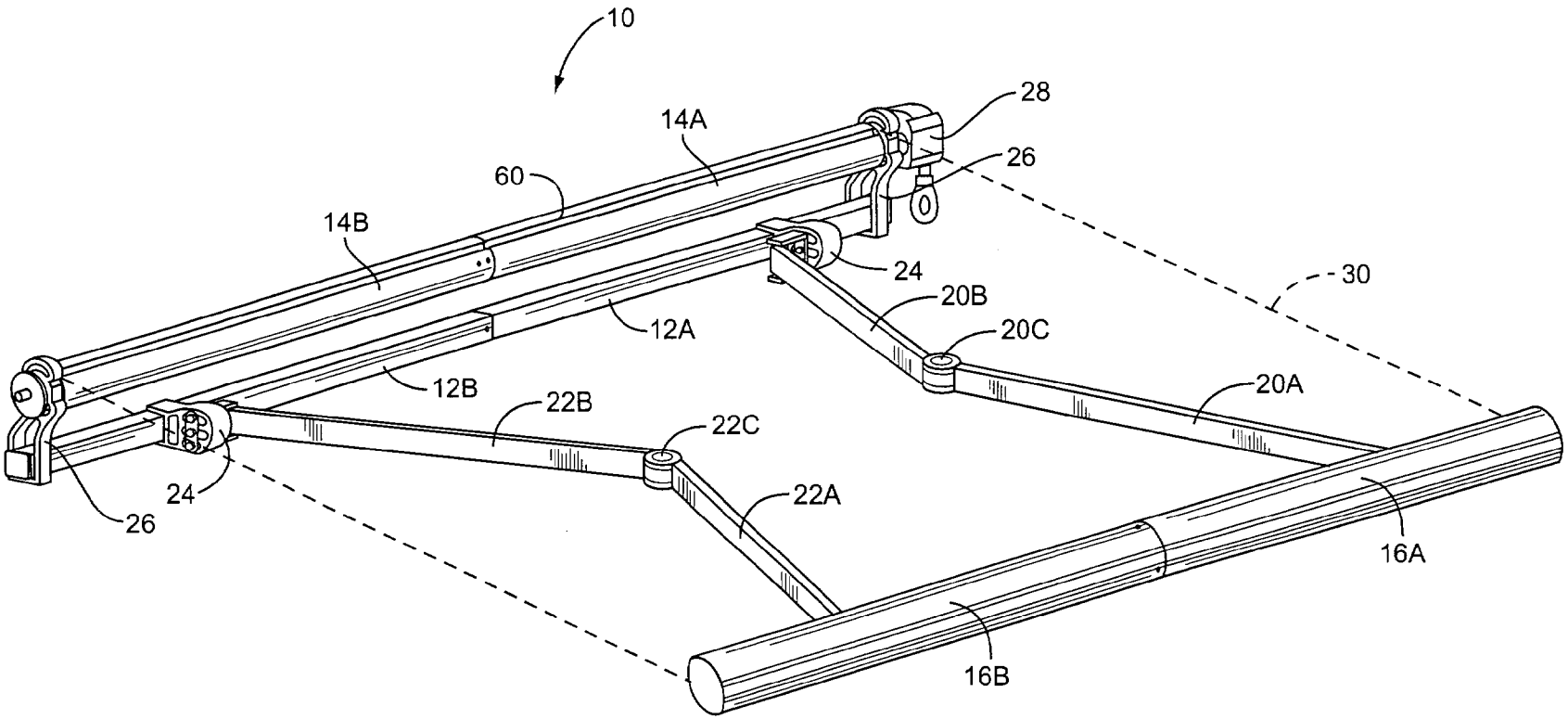
FIG. 1 is a perspective view of the retractable awning of the present invention.

With further reference to the drawings, the retractable awning of the present invention is shown therein and indicated generally by the numeral 10. Retractable awning 10 is designed to be mounted to the side of a structure such as a residential dwelling. It should be pointed out that retractable awnings of the general type disclosed herein are known in the prior art and therefore, a detailed discussion of each and every element of the retractable awning 10 will not be dealt with herein because such is not per se material to the present invention and, as mentioned above, retractable awnings of this general type are known and are commercially available.

Viewing retractable awning 10, the same includes a frame structure that is designed to be directly mounted to a support structure such as the side of a residential dwelling. Disposed over the frame structure is a rotatively driven roll bar that functions to hold and store an awning sheet 30. As will be appreciated from subsequent portions of this disclosure, when the retractable awning is in a retracted position the awning sheet 30 will be rolled around and stored on the roll bar. When the retractable awning 10 is extended, a substantial portion of the awning sheet 30 will be unrolled from the roll bar and will extend out with a lead bar. The lead bar is secured to the frame by a pair of extendable arms as illustrated in FIG. 1.

Frame, roll bar and lead bar are divided into two or more sections. In particular, and with further reference to the drawings, the frame includes a pair of frame sections 12A and 12B. Likewise, the roll bar includes a pair of roll bar sections 14A and 14B. Similarly, the lead bar comprises a pair of lead bar sections 16A and 16B. In the case of the embodiments shown in the drawings, the retractable awning 10 and its basic components just described, are split in half. However, it should be appreciated by those skilled in the art, that these very same components can be divided or split into three or more sections. It will be noted that each of the sections referred to above, that is frame sections 12A and 12B, roll bar sections 14A and 14B, and lead bar sections 16A and 16B, each have an inboard end and an outboard end. Because the various sections can be coupled or connected together, the inboard ends of the various sections will mate or be joined together to form an assembled retractable awning 10 such as that illustrated in FIG. 1.

As noted earlier, lead bar and its respective sections 16A and 16B are supported in cantilever fashion by a pair of arm structures that are interconnected between the frame sections 12A and 12B and the sections 16A and 16B of the lead bar. One arm structure, as shown in FIG. 1, includes a pair of arms 20A and 20B. These arms are interconnected by a pivot pen or pivot joint 20C. Arm 20B is connected to frame section 12A by an arm bracket 24. In similar fashion, the other arm structure includes a pair of arms 22A and 22B. These arms are connected together by a pivot pen or pivot joint 22C. Arm 22B is connected to frame section 12B through a bracket 24. Arms similar to those shown in the drawings and described above are well known and are used in retractable awnings of the prior art. These arms are movable from a retracted position such as partially illustrated in FIGS. 3 and 4 to an extended position such as illustrated in FIG. 1. Each of the arm structures is provided with a biasing structure for biasing the respective arms towards an extended position. Generally, this biasing structure includes a spring structure disposed internally within one or both of the arms which comprise one of the arm structures disposed on one side of the retractable awning. As will be described subsequently, the arm structure just described, because of its biasing nature, assists in moving the awning to an extended or partially extended position as shown in FIG. 1. By the same token, when the awning sheet is retracted and rolled around the roll bar sections 14A and 14B, the biasing force of the arms must be overcome.

When the retractable awning 10 is in the assembled mode, as viewed in FIG. 1, the roll bar sections 14A and 14B are supported above or in a spaced apart relationship to the frame sections 12A and 12B. To provide the support, there is provided a pair of roll bar support brackets 26. Although not particularly shown, each roll bar bracket 26 is adapted to rotatively hold and support the roll bar sections 14A and 14B. That is, the outboard ends of each section 14A and 14B is held within a respective bracket 26 such that the combined or joined together roll bar sections 14A and 14B can rotate therein. Mounted adjacent one end of one roll bar section 14A or 14B is a gear assembly 28. Gear assembly 28, when appropriately mounted adjacent one of the roll bar sections 14A or 14B, is drivingly interconnected with one of the sections. Extending downwardly from the gear assembly 28 is a relatively short crank arm that is adapted to be connected to an extended crank arm (not shown). By turning the extended crank arm, the gear assembly 28 is driven which in turn drives the roll bar sections 14A and 14B. It should be appreciated that the roll bar sections 14A and 14B can be driven by other means such as an electric motor that can even be remotely controlled.

As discussed above, connected between the roll bar sections 14A and 14B and the lead bar sections 16A and 16B, there is provided an awning sheet 30. Although the awning sheet 30 may be connected to these components in various ways, it is contemplated that in one embodiment, that the awning sheet 30 would be connected to the roll bar sections 14A and 14B and the lead bar sections 16A and 16B after the retractable awning 10 has been assembled and when the lead bar sections 16A and 16B is disposed in an extended or at least a partially extended position.

Figure 2:
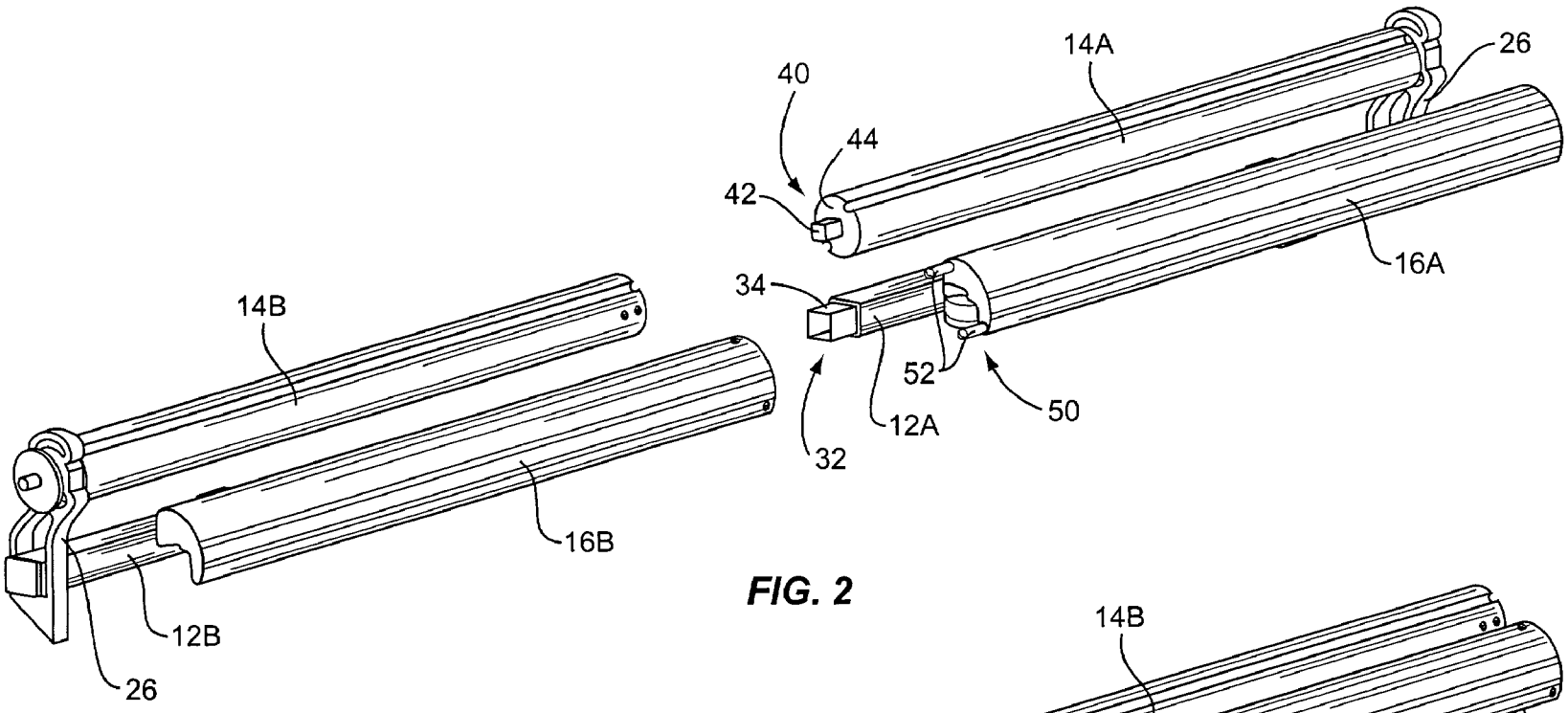
FIG. 2 is a perspective view of the retractable awning with its basic components being split into two sections.

As seen in the drawings, the retractable awning 10 can be split or divided into two sub-assemblies. See FIG. 2. Each sub-assembly is comprised of one frame section, one roll bar section, and one lead bar section. To secure one sub-assembly to another sub-assembly, or in other words, to secure the various sections together, there is provided a series of couplers. As illustrated in FIG. 2, there is provided a first coupler, indicated generally by the numeral 32, for coupling the individual frame sections 12A and 12B together. A second coupler, indicated generally by the numeral 40, is provided to couple the individual roll bar sections 14A and 14B together. Finally, a third coupler, indicated generally by the numeral 50, is provided to couple the individual lead bar sections 16A and 16B together.

Figure 3:
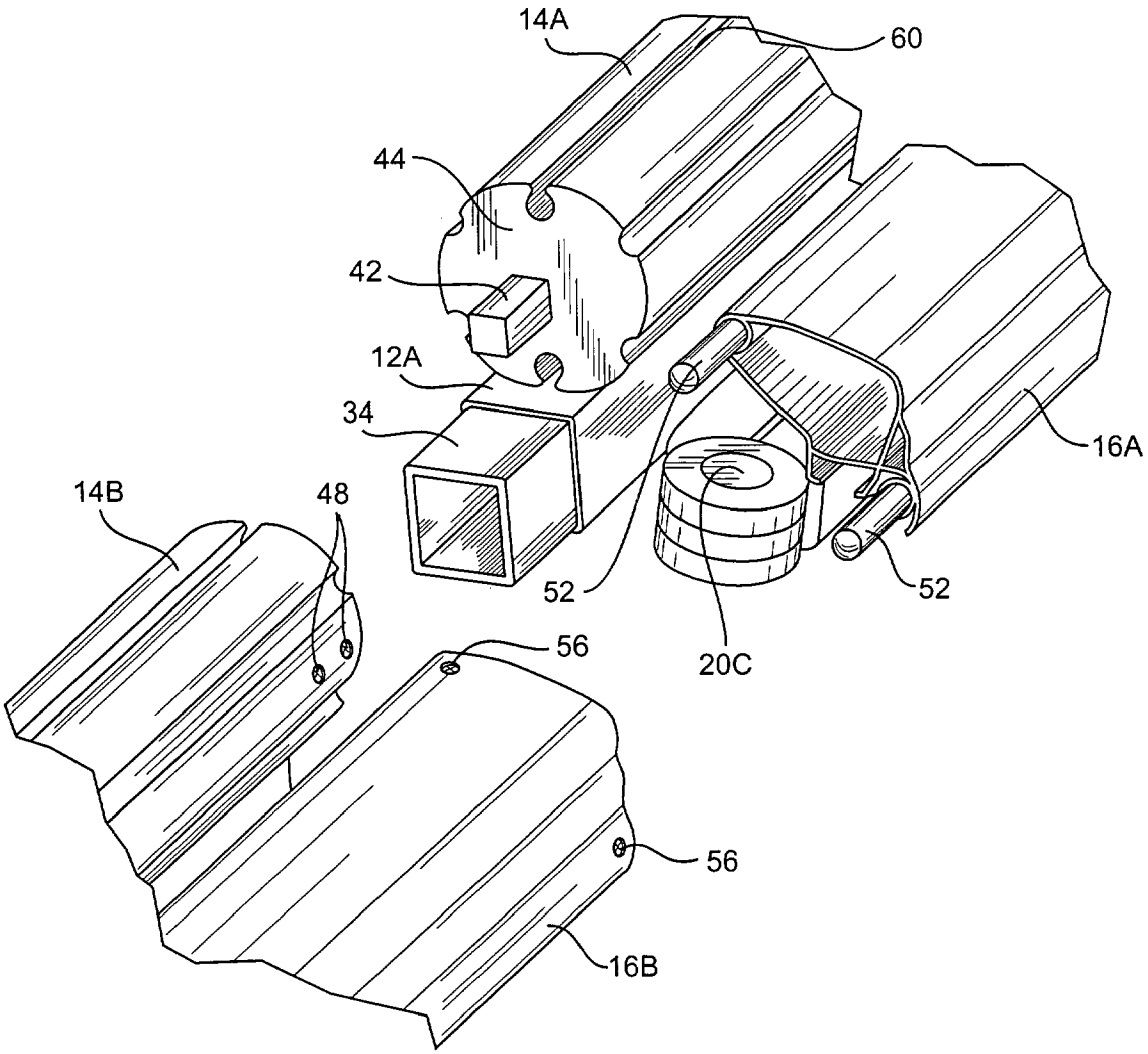
FIG. 3 is a fragmentary perspective view particularly illustrating the inboard ends of one section of the frame, roll bar and lead bar.
Figure 4:
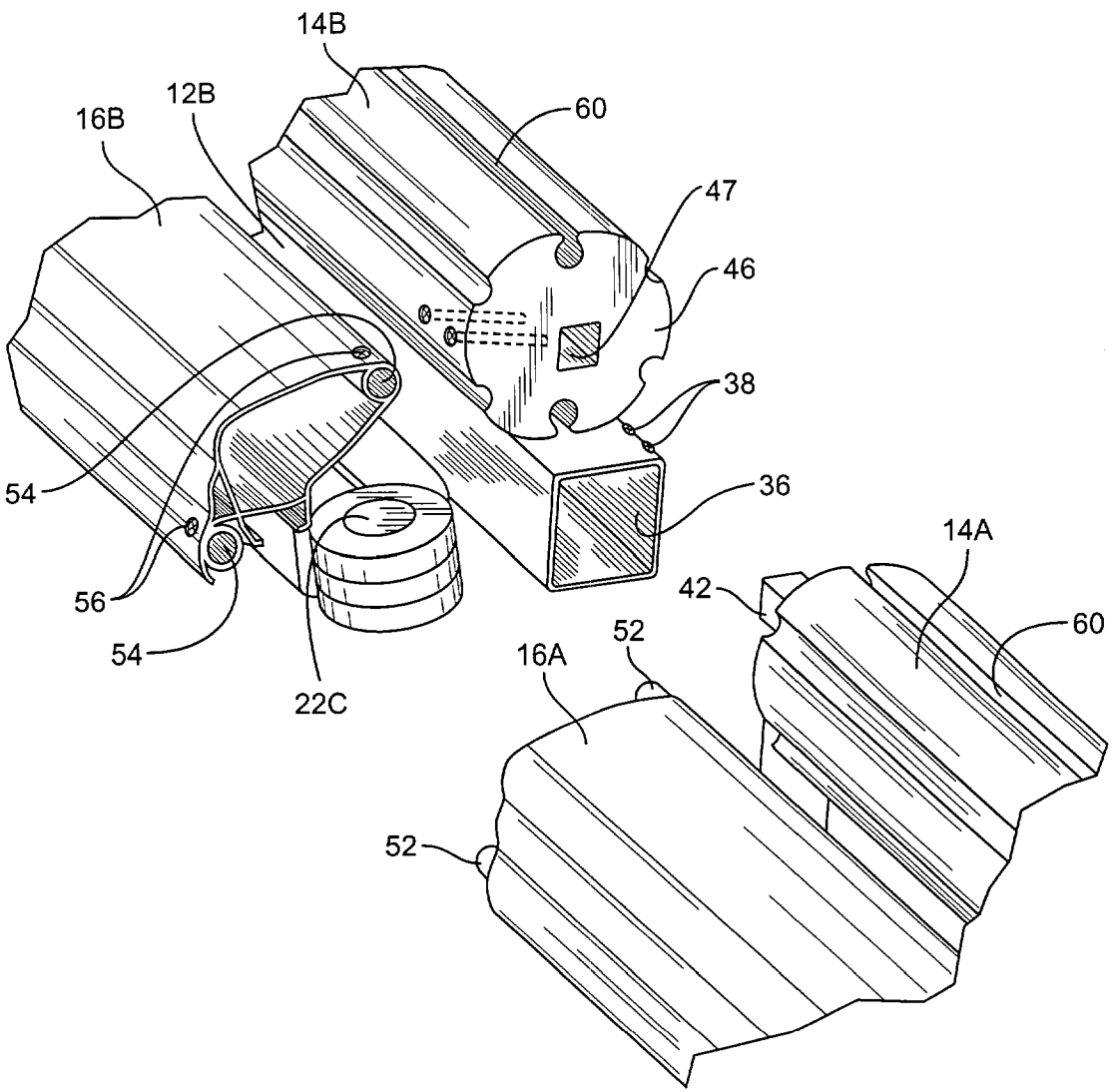
FIG. 4 is a fragmentary perspective view particularly illustrating the inboard ends of the other section of the frame, roll bar and lead bar.
Figure 5:
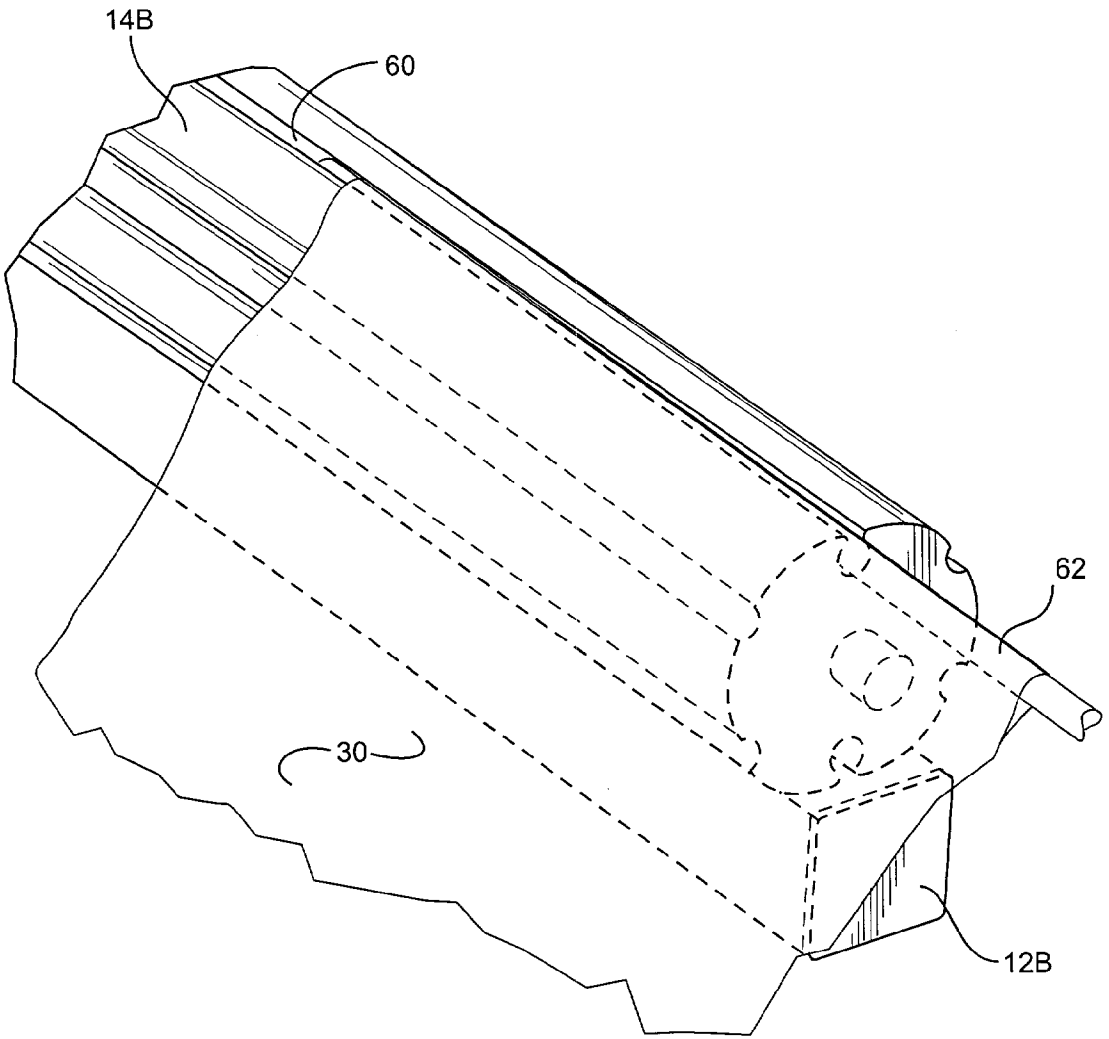
FIG. 5 is a fragmentary perspective view illustrating how the awning sheet 30 can be connected to the roll bar of a retractable awning.

First, with reference to the first coupler 32, the same includes an inner sleeve or connector 34 and an outer sleeve 36 along with one or more bolts or set screws 38. In FIG. 3, it is seen where the inner sleeve or connector 34 projects from the inboard end of frame section 12A. About the inboard end of the other frame section 12B, the outer sleeve 36 is adapted to receive the inner sleeve 34. There are numerous ways of connecting the frame sections 12A and 12B together. In one embodiment, the inner sleeve 34 and outer sleeve 36 can be dimensioned or sized so as to generate a tight or frictional fit. In the case of the embodiment illustrated herein, the inner sleeve 34 is secured tightly within outer sleeve 36 by the one or more bolts or set screws 38 formed in the outer sleeve 36. These bolts or set screws 38 are simply tightened down on the inner sleeve 34 when the inner sleeve is inserted into the outer sleeve. Note that the bolts or set screws 38 are directed through a corner seam or edge of the outer sleeve 36. This jams a corner of the inner sleeve 34 against the corner of the outer sleeve 36 opposite the bolts or set screws 38, and firmly attaches one section of the frame with another section of the frame. It will be appreciated that the position of the inner sleeve 34 and the outer sleeve 36 can be reversed. That is, the inner sleeve 34 can project from the inboard end of either section 12A or 12B, and the same can be said for the outer sleeve 36.

Turning to the roll bar sections 14A and 14B, it is appreciated that due to the nature and function of the roll bar assembly that it is necessary to provide an interconnecting drive between the inboard ends of the respective sections 14A and 14B. This interconnecting drive forms a part of the second coupler 40. In this case, there is provided a driver or drive shaft 42 that extends from roll bar section 14A and when the retractable awning 10 is coupled the driver or drive shaft 42 projects into a receiver 47 shown in FIG. 4. In the inboard end of the roll bar section 14A there is provided a first plate 44. First plate 44 is anchored and secured in the inboard end such that as the roll bar section 14A turns the first plate 44 is constrained to turn also. Driver or drive shaft 42 is secured to the first plate 44 and turns therewith. Likewise, in the inboard end of the other roll bar section 14B there is provided a second plate 46 which is secured within the inboard end of the other roll bar section 14B. Like first plate 44, second plate 46 is firmly secured within the inboard end of section 14B such that section 14B and second plate 46 are constrained to move together. Although a frictional or interference fit may be sufficient to couple roll bar sections 14A and 14B together, in the embodiment illustrated herein, there is provided one or more counter sunken bolts or set screws 48 in roll bar section 14B. These one or more bolts or set screws 48 are designed to extend into and engage the driver or drive shaft 42 when inserted within receiver 47.

Third coupler 50 associated with lead bar sections 16A and 16B, comprises a pair of stub shafts 52 that project from the inboard end of lead bar section 16A. See FIG. 3. To receive stub shafts 52, there is provided a pair of spaced apart receivers 54 formed in the inboard end of the other lead bar section 16B. Again, frictional or interference fits may suffice to couple the lead bar sections 16A and 16B together. However, in this case there is provided one or more bolts or set screws 56 particularly placed in lead bar section 16B so as to engage stub shafts 52 when inserted within the receivers 54.

As discussed above and is shown in the drawings, various forms of a coupler can be utilized to connect the respective sections of the retractable awning 10 together. For example, the type of coupler disclosed as the first coupler 32 could be utilized to couple other sections of the retractable awning together.

Awning sheet 30 may be inserted after the retractable awning has been assembled and extended as shown in FIG. 1. The roller bar sections 14A and 14B include a series of circumventially spaced grooves 60 formed in the outer surface. These grooves extend longitudinally along the surface of the roller bar sections 14A and 14B. Opposed ends of the awning sheet 30 are provided with a plastic or other connector 62. One plastic connector 62 is adapted to be threaded from the end or side into one groove 60 formed in the roller bar sections 14A and 14B. It is noted that when the roller bar sections 14A and 14B are coupled together, the grooves 60 in each section align with each other. Thus, the end 62 of the sheet awning 30 can be inserted from the end or side into one of the grooves 60 and simply extended downwardly until the sheet awning 30 is aligned with the combined roller bar sections 14A and 14B. Likewise, the lead bar sections 16A and 16B includes a similar groove that is not particularly shown in the drawings. In any event, the other end of the awning sheet 30 is inserted into the groove of the lead bar sections 16A and 16B in the same fashion. Thus, once the opposed ends 62 of the awning section have been inserted into two separate grooves of the roll bar sections and the lead bar sections, it is appreciated that the awning sheet is connected between the roll bar sections 14A and 14B and the lead bar section 16A and 16B.

The retractable awning 10 of the present invention can be provided with a device for angling the arm structures up and down with respect to the frame sections 12A and 12B. Typically, there is provided a turn rod on each end of the retractable awning 10. By turning each turn rod one side of the awning including one set of arm members 20A and 20B or 22A and 22B can be raised or lowered, as desired. The particular structure for accomplishing that function is not specifically shown herein, but is well known and appreciated by those skilled in the art as such mechanisms are provided on commercially available retractable awnings.

Figure 6A:
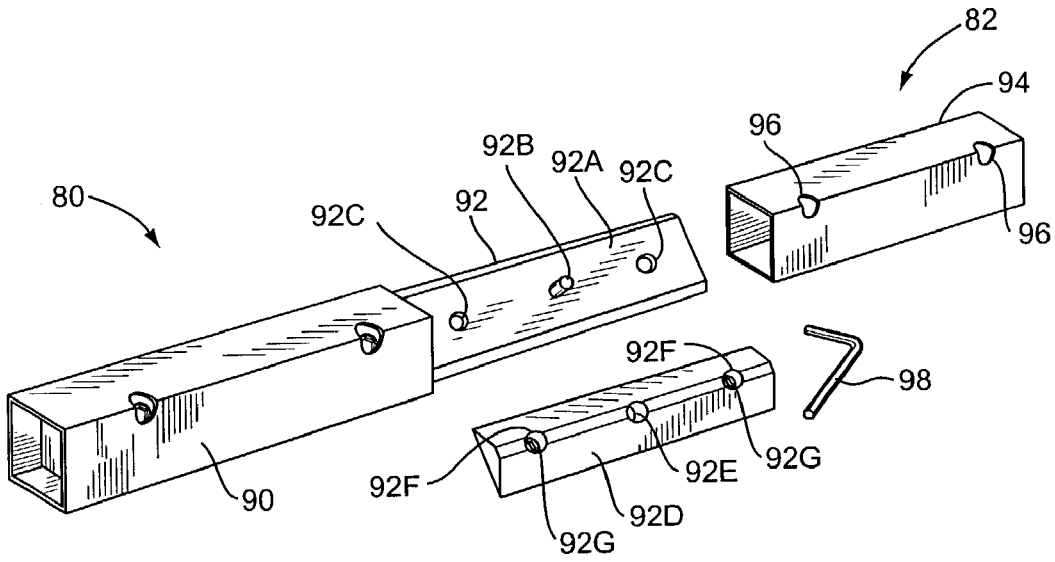
FIG. 6A is an exploded perspective view of a coupler that could be utilized to connect any two corresponding sections of the awning.
Figure 6B:
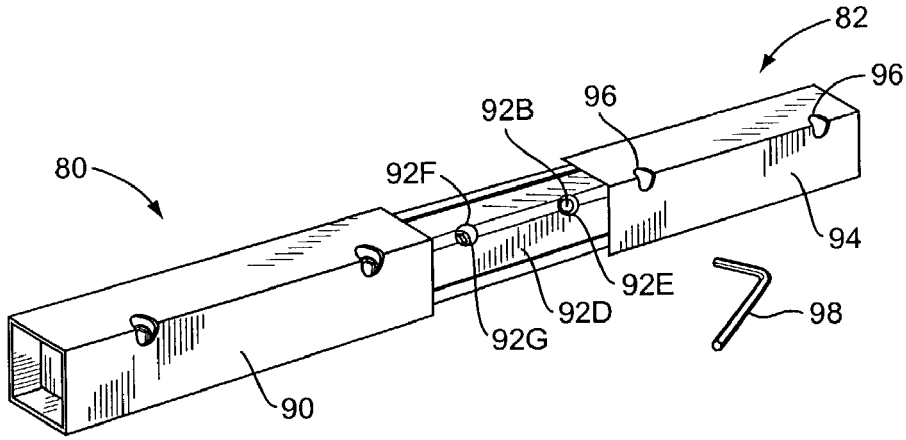
FIG. 6B is a perspective view of the coupler of FIG. 6A showing the two sections being connected.
Figure 6C:
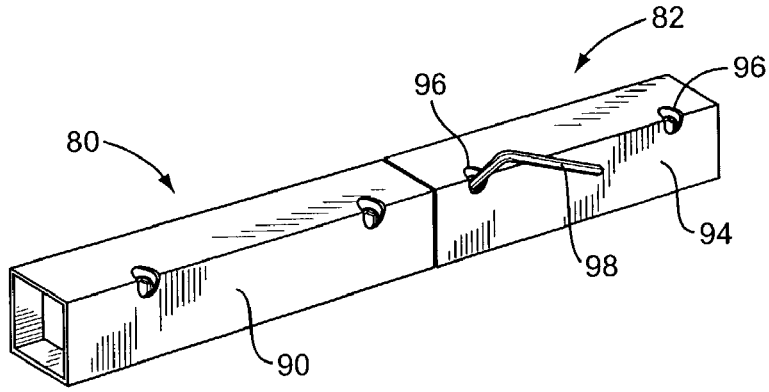
FIG. 6C is a perspective view of the coupler of FIG. 6A in a connected configuration.

FIGS. 6A–6C illustrate an alternate design for a coupler for securing the various sections of the retractable awning 10 together. That is, the type of coupler illustrated in FIGS. 6A–6C could be utilized to connect the frame sections 12A and 12B, the roll bar sections 14A and 14B and the lead bar sections 16A and 16B.

Turning to a discussion of the alternate coupler, the same comprises two sections, a first section indicated generally by the numeral 80 and a second section indicated generally by the numeral 82. First, with respect to section 80, the same includes a sleeve 90 secured to a wedge bar assembly 92. Note that the wedge bar assembly 92 is secured within sleeve 90 by suitable securing means and projects outwardly therefrom to where an outer end portion of the wedge bar assembly can be exposed as illustrated in FIG. 6A. The exposed portion of wedge bar assembly 92 as viewed in FIG. 6A, includes a diagonal face 92A. Projecting outwardly from the diagonal face 92A is a position stud 92B. Disposed on each side of the position stud 92B is a screw recess 92C.

Forming a part of the wedge bar assembly 92 is a corner wedge 92D. Corner wedge 92D includes a central opening 92E for receiving the position stud 92B. Disposed on each side of opening 92E is another opening 92F. Each opening 92F is threaded and includes an allen screw 92G secured therein.

Turning to the second section 82, the same includes a rectangular sleeve 94 that is adapted to slide over the exposed portion of the wedge bar assembly 92. Note that about one corner seam of the sleeve 94, there is provided a pair of corner openings 96.

It is appreciated that the sections 80 and 82 would form a part of the retractable awning 10, with the first section 80 forming a part, for example, of frame section 12A while the other section, section 82, would form a part of the other frame section 12B. In any event, to connect sections 80 and 82 together, the corner wedge 92D is placed on the diagonal face 92A. The allen screws 92G are sufficiently retracted into the corner wedge 92D such that the combined cross sectional area of the wedge bar assembly 92 will permit the sleeve 94 to be inserted thereover. Once sleeve 94 is inserted over the wedge bar assembly 92 as shown in FIG. 6C, an allen wrench 98 is extended through the openings 92F and engaged with the allen screws 92G. By appropriately turning the allen wrench 98, the allen screws 92G are moved outwardly from the corner wedge 92D and engage the recesses 92C formed in the diagonal face 92A. As the allen screws 92G are turned, the corner wedge 92D is caused to move outwardly and wedge against the interior corner of sleeve 94. By tightening the alien screws 92G, the corner wedge 92D is securely wedged against the interior corner of the sleeve 94 and a secure connection is made.

The coupler illustrated in FIGS. 6A and 6C shows that the sleeve 90 is likewise connected to another portion of the wedge bar assembly 92. It will be appreciated that this arrangement and method of connection is the same as described above. In other cases, it is possible for the sleeve 90 and wedge bar assembly 92 to simply be fixedly connected.

When the retractable awning 10 is manufactured, it is contemplated that the retractable awning would be split or divided into two or more subassemblies. In the case of the embodiment shown in FIG. 1, frame section 12A, roller bar section 14A, lead bar section 16A and the arms 20A and 20B interconnected between frame section 12A and lead bar section 16A would form one sub-assembly. Likewise, the other sub-assembly would include frame section 12B, roller bar section 14B, lead bar section 16B and arms 22A and 22B. These two sub-assemblies would be shipped in a retracted position. That is, each arm would assume a folded position such that the folded arm structure would lie between a respective frame section and a respective lead bar section. See, for example, FIG. 2. Next, it is contemplated that the respective sub-assemblies would not be packaged end-to-end, but would be packaged in parallel fashion. That is, one sub-assembly would lie adjacent another sub-assembly. This would shorten the packaging and would ultimately reduce the shipping cost. In addition, when the sub-assemblies are packaged in parallel as just described, the same packaging will lend itself to a more compact merchandising presentation. For example, if the retractable canopy, when assembled, has a span of 16 feet, in a parallel package as just described, the total length of the package should not be much more than 8 feet.

One of the many advantages of the retractable awning of the present invention is that the design enables the retractable awning to be compactly packaged. Essentially, the left hand half of the retractable awning assembly, shown in FIG. 2, can be laid adjacent the right hand half of the assembly and the two subassemblies can be placed or packaged together, in side-by-side relationship, in the same container.

Figure 7:
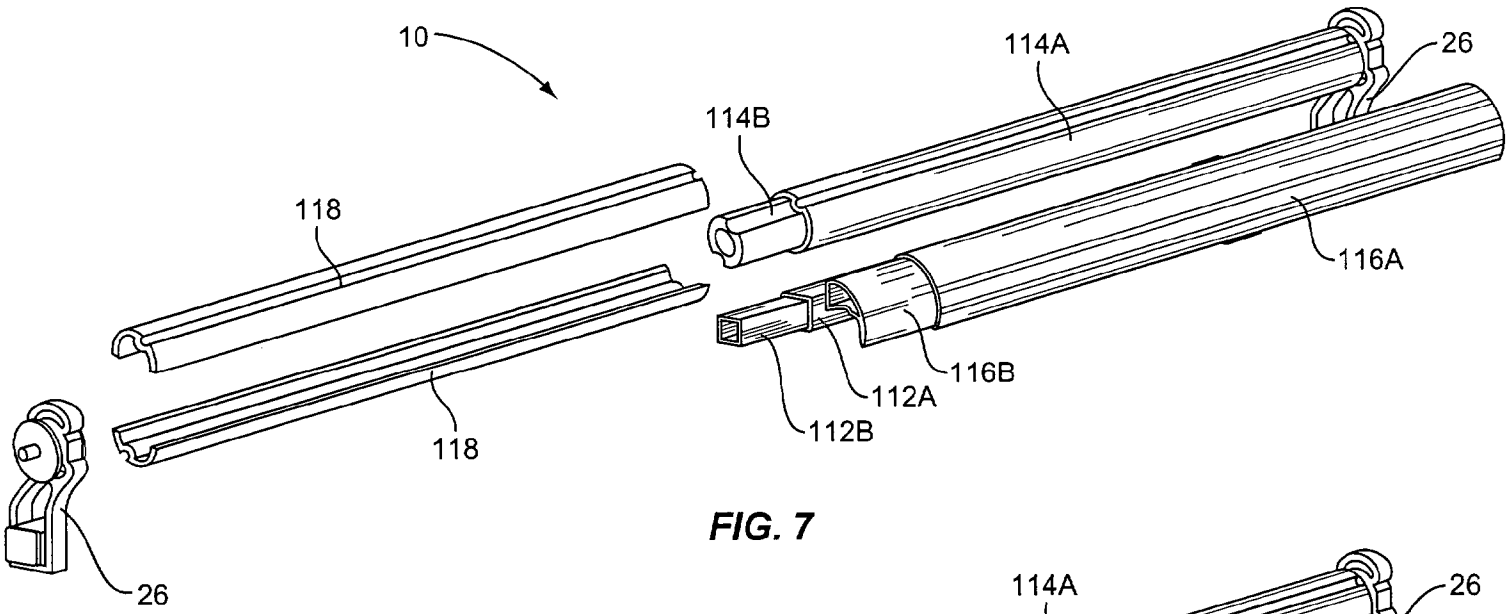
FIG. 7 is a perspective view of an alternative design for the retractable awning which includes telescoping sections and wherein the telescoping sections are retracted and the awning is shown in a retracted or packaging mode.
Figure 8:
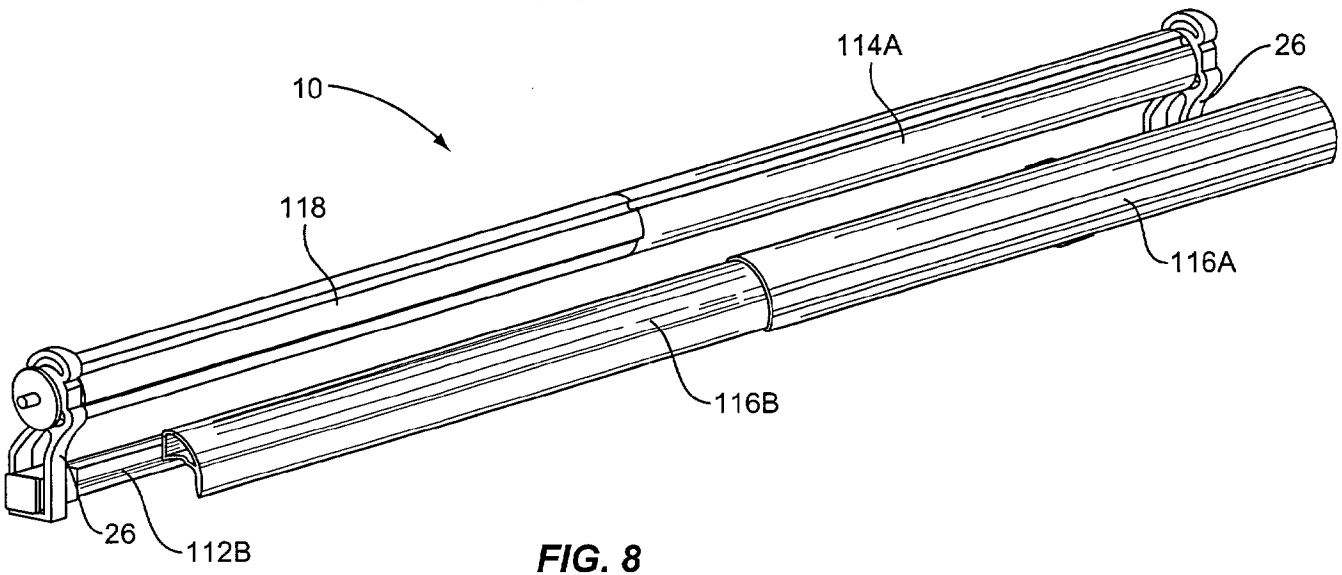
FIG. 8 is a perspective view of the retractable awning shown in FIG. 7, but in an extended or operative mode.
Figure 9:
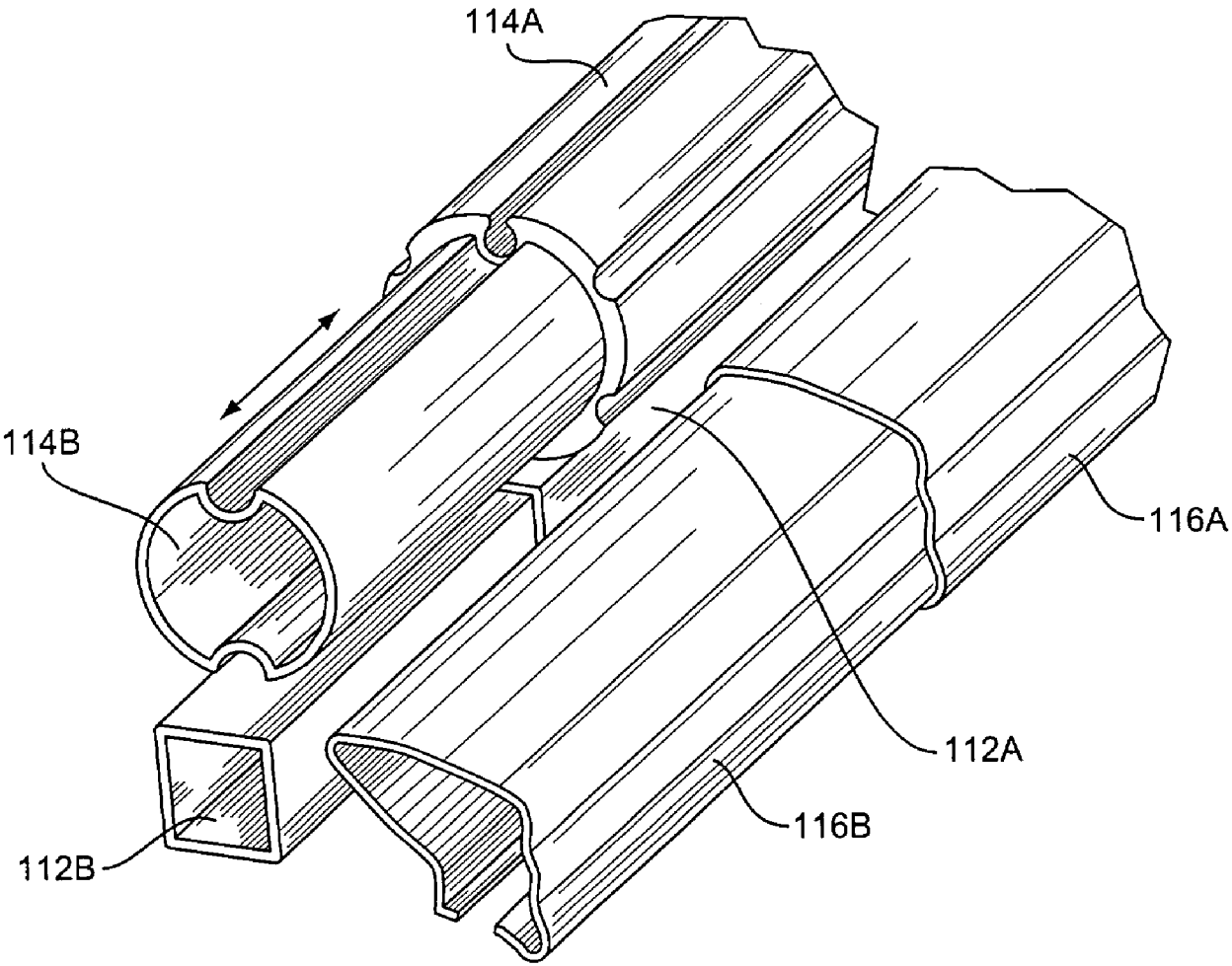
FIG. 9 is a perspective view of a portion of the telescoping retractable awning shown in FIGS. 7 and 8.

Turning to FIGS. 7–9, a second embodiment for the retractable awning of the present invention is shown therein. In this case, the retractable awning is telescoping. That is, in a preferred embodiment, each of the frame structure, roll bar and lead bar include at least two telescoping sections. Note in FIG. 7 where the frame structure includes two sections 112A and 112B. Section 112B can slide in and out of section 112A. Likewise, the roll bar includes sections 114A and 114B. Section 114B is contained within section 112 and is slidable back and forth therein. Further, the lead bar includes two sections 116A and 116B. Section 116B can slide back and forth in section 116A.

When the retractable awning assumes the operative position, as shown in FIG. 8, it is desirable for the diameter and circumference of the roll bar sections 114A and 114B to be generally equal. Because of the telescoping nature of the design, it is seen that section 114B, as shown in FIG. 7, would be smaller in diameter and circumference than section 114A. To compensate for this, the present invention is provided with a pair of panels 118 that are designed to be secured around the outside of section 114B. Cover panels 118 can be secured in various ways such as by screws. Further, the respective cover panels 118 would be designed with elongated grooves similar to those shown in FIG. 1 and indicated by the numeral 60. The cover panels would be secured to section 114B such that the grooves in the cover panels 118 would align with the grooves formed in the outer surface of section 114A. Therefore, it follows that the awning sheet could be conveniently attached to the roll bar sections when the roll bar assumes the expanded or operative mode shown in FIG. 8.

It is appreciated that the various sections that comprise the frame structure, roll bar and lead bar would be provided with stops so as to prevent the inner sections from sliding out from the outer sections.

Figure 2A:
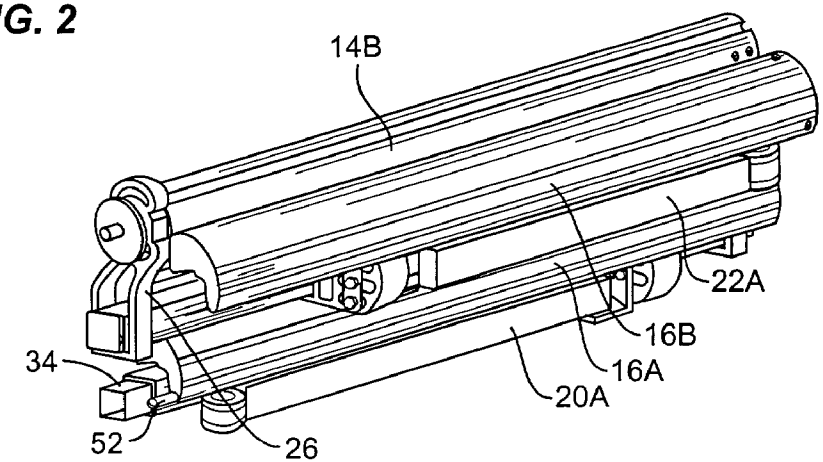
FIG. 2A is a perspective view showing the two sections being disposed side by side in a packaging-type configuration.

FIG. 7 shows the retractable awning 10 in a packaged mode or state. Here, the inner sections are retracted into the outer sections. FIG. 8 shows the retractable awning 10 in an expanded or operative mode. Note that the length of the retractable awning in the operative mode is substantially greater than the length of the awning shown in FIG. 7 and is also substantially greater than the effective length of the two subassemblies shown in a general packaging configuration in FIG. 2A. It follows that when the awning is disposed in the configuration shown in FIGS. 2A and 7 that the effective length of the awning is substantially less than the length of the awning when it is disposed in an operative position such as shown in FIGS. 1 and 8. Consequently, a package of less length can be utilized and this makes shipping more cost effective. Further, this makes the retractable awning more attractive from a merchandising point of view because in the packaged mode, the retractable awning takes up less space in a retail outlet than when the retractable awning assumes the operative or extended mode.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A retractable awning comprising:

a. a frame structure forming a part of the awning;

b. a roll bar forming a part of the awning;

c. a lead bar forming a part of the awning;

d. wherein the frame structure of the awning includes two separable sections;

e. wherein the roll bar of the awning includes two separable sections;

f. wherein the lead bar of the awning includes two separable sections;

g. a first coupler for connecting the sections of the frame structure;

h. a second coupler for connecting the sections of the roll bar;

i. a third coupler for coupling the sections of the lead bar;

j. wherein the frame structure and roll bar sections of the awning may be coupled together by the respective couplers to form the awning; and k. a pair of retractable and extendable arms interconnected between the frame structure and lead bar for extending and retracting the lead bar with respect to the frame structure.

2. The retractable awning of claim 1 wherein at least one of the couplers comprises a male-female connector.

3. The retractable awning of claim 1 wherein the second coupler includes a drive member for transferring torque from one section of the roll bar to another section of the roll bar.

4. The retractable awning of claim 1 including an awning sheet adapted to be connected between the roll bar and the lead bar.

5. The retractable awning of claim 4 wherein the frame structure, roll bar, lead bar and awning sheet form a part of an awning kit and wherein the awning sheet is adapted to be connected to the rail bar and lead bar after the respective sections of the frame structure, roll bar and lead bar have been connected together by the couplers.

6. The retractable awning of claim 1 wherein the roll bar is rotatively driven and wherein the second coupler for connecting the sections of the roll bar includes a shaft extending from one section into engagement with the other section such that the rotation of one section results in the rotation of the other section.

7. The retractable awning of claim 1 wherein the roll bar includes a rotatable elongated cylinder that is split into the at least two sections with each section including an inboard end and an outboard end, and wherein the second coupler for connecting the at least two sections includes at least one projecting member that projects from the inboard end of one section into engagement with the inboard end of the other section.

8. The retractable awning of claim 1 wherein when the sections of the frame structure, roll bar and lead bar are connected there is defined an interface between each pair of joined sections.

9. The retractable awning of claim 1 wherein the roll bar includes an outer curved surface, wherein the second coupler when coupling the sections of the roll bar together, is disposed inwardly of the outer surface of the roll bar.

10. The retractable awning of claim 1 wherein one of the retractable and extendable arms is connected between one section of the frame structure and one section of the lead bar, and wherein the other retractable and extendable arm is connected between the other section of the frame structure and the other section of the lead bar.

11. The retractable awning of claim 10 wherein each extendable and retractable arm includes a pivot joint that divides the arm into two sections.

12. A method of manufacturing and packaging a retractable awning comprising:

a. forming a frame structure of the retractable awning into at least two separate sections;

b. providing a first coupler for coupling the two sections of the frame structure together;

c. forming a roil bar of the retractable awning into at least two separate sections;

d. providing a coupler for coupling the two sections of the roil bar together;

e. forming a lead bar of the retractable awning into at least two separate sections;

f. providing a third coupler for coupling the two sections of the lead bar together;

g. packaging the frame structure, roll bar and lead bar into a package where the length of the package does not substantially exceed the length of the longest section of the frame structure, roll bar, or lead bar; and h. connecting an extendable and retractable arm between one section of the frame structure and one section of the lead bar; and connecting a second extendable and retractable arm between the other section of the frame structure and the other section of the lead bar such that the lead bar can be extended and retracted relative to the frame structure.

13. The method of claim 12 wherein the sections are disposed in parallel relationship within the package.

14. The method of claim 12 wherein the retractable awning is assembled by:

a. coupling the sections of the frame structure together;

b. coupling the sections of the roll bar together; and c. coupling the sections of the lead bar together.

15. The method of claim 14 wherein coupling the sections of the roll bar together include extending a drive member from one section into engagement with the other section such that the rotation of one section results in the rotation of the other section.

16. The method of claim 14 including after the roll bar and lead bar have been assembled, connecting a sheet awning to both the roll bar and lead bar.

17. A retractable awning, comprising:

a. a frame structure forming a part of the awning;

b. a lead bar forming a part of the awning;

c. at least two separate roll bar sections forming a part of the awning with each section having opposed end portions;

d. a coupler for interconnecting the roll bar sections, the coupler including a driver that extends from one roll bar section to the other roll bar section and connects the two sections such that the rotation of one section results in the rotation of the other section; and e. a pair of retractable and extendable arms and wherein the retractable and extendable arms are interconnected between the frame structure and the lead bar such that by extending the arms the lead bar is extended outwardly away from the frame structure and by retracting the arms the lead bar is moved inwardly towards the frame structure.

18. The retractable awning of claim 17 wherein the coupler includes at least one plate secured to one section and wherein the driver is connected to the plate.

19. The retractable awning of claim 17 wherein the coupler includes a pair of plates, one plate secured to one section and the other plate secured to another section; and wherein the driver is interconnected between the two plates.

20. The retractable awning of claim 19 wherein each section includes an inboard end and an outboard end and wherein the plates are secured to the inboard ends of the sections.

21. The retractable awning of claim 20 wherein the driver includes a shaft that extends between the two plates.

22. The retractable awning of claim 17 wherein each section includes an inboard end and an outboard end and wherein the driver includes a shaft that is coupled to the two inboard ends of the two sections.

23. The retractable awning of claim 17 wherein the frame structure includes two separate sections and the lead bar includes two separate sections, and wherein one of the retractable and extendable arms is connected between one section of the frame structure and the one section of the lead bar and the other retractable and extendable arm is connected between the other section of the frame structure and the other section of the lead bar.

24. A retractable awning comprising:

a. a frame structure forming a part of the awning;

b. a lead bar forming a part of the awning;

c. a roll bar forming a part of the awning;

d. wherein at least one of the frame structure, lead bar or roll bar includes first and second sections with the first section being telescopically contained within the other section such that the first section can be retracted into the second section or extended from the second section;

e. wherein the lead bar is movable back and forth with respect to the frame structure;

f. wherein the length of at least one of the frame structure, lead bar or roll bar can be adjusted and varied by retracting one of the sections into the other section; and g. a pair of retractable and extendable arm and wherein the retractable and extendable arms are interconnected between the frame structure and the lead bar such that by extending the arms the lead bar is extended outwardly away from the frame structure and by retracting the arms the lead bar is moved inwardly towards the frame structure.

25. The retractable awning of claim 24 wherein each of the frame structure, lead bar and roll bar include first and second sections wherein the first section is telescopically contained within the second section.

26. The retractable awning of claim 24 wherein the roll bar includes first and second sections and wherein the first section is telescopically contained within the second section such that the first section can be retracted into the second section or extended from the second section.

27. The retractable awning of claim 24 wherein the frame structure includes two separate sections and the lead bar includes two separate sections, and wherein one of the retractable and extendable arms is connected between one section of the frame structure and the one section of the lead bar and the other retractable and extendable arm is connected between the other section of the frame structure and the other section of the lead bar.

28. A retractable awning comprising:

a. a frame structure forming a part of the retractable awning;

b. a roll bar forming a part of the retractable awning;

c. a lead bar forming a part of the retractable awning;

d. wherein the lead bar of the retractable awning is movable back and forth with respect to the frame structure;

e. wherein at least one of the frame structure, lead bar or roll bar of the retractable awning includes two sections movable with respect to each other such that the two sections can assume a shipping mode and an operative mode; and f. wherein in the operative mode the two sections of the retractable awning are generally aligned and extend a selected length;

g. when the retractable awning assumes the shipping mode the two sections of the retractable awning are oriented with respect to each other such that the two sections of the retractable awning together assume a length substantially less than the selected length assumed when the two sections of the retractable awning assume the operative mode; and h. including first and second retractable and extendable arms where the arms are interconnected between the frame structure and the lead bar for moving the lead bar outwardly and inwardly with respect to the frame structure.

29. The retractable awning of claim 28 further including at least one coupler for coupling the two sections together.

30. The retractable awning of claim 28 wherein one section is telescopically contained within the other such that one section can be retracted into the other or extended from the other.

31. The retractable awning of claim 28 wherein each of the frame structure, lead bar and roll bar include the two sections.

32. The retractable awning of claim 31 further including at least three couplers, one coupler for connecting the two sections of the frame structure, a second coupler for connecting the two sections of the lead bar, and a third coupler for connecting the two sections of the roll bar.

33. The retractable awning of claim 31 wherein the two sections of the frame structure are telescopically connected, and wherein the two sections of the lead bar are telescopically connected, and wherein the two sections of the roll bar are telescopically connected.

34. The retractable awning of claim 28 wherein the frame structure includes two separate sections and the lead bar includes two separate sections and wherein one retractable and extendable arm is connected between one section of the frame structure and one section of the lead bar and the other retractable and extendable arm is connected between the other section of the frame structure and the other section of the lead bar.

35. A method of assembling a retractable awning comprising a frame structure having two separate frame sections, a roll bar having two separate roll bar sections, a lead bar having two separate lead bar sections and an awning sheet, comprising:

a. forming a part of the retractable awning by connecting the two separate frame sections together to farm a frame structure of the retractable awning;

b. forming another part of the retractable awning by connecting the two separate roll bar sections together such that the rotation of one section will result in the rotation of the other section;

c. forming another part of the awning by connecting the two separate lead bar sections together to form a lead bar far the awning;

d. after connecting the roll bar sections and the lead bar sections, connecting the awning sheet to both the formed roll bar and the formed lead bar;

e. interconnecting the frame structure and the lead bar by connecting a pair of retractable and extendable arms between the respective sections of the frame structure and the respective sections of the lead bar such that by extending the arms the lead bar is moved outwardly away from the frame structure and by retracting the two arms the lead bar is moved inwardly towards the frame structure.

36. The method of claim 35 including extending the lead bar outwardly and away from the roll bar prior to connecting the awning sheet to the formed roll bar and formed lead bar.

37. The method of claim 35 wherein connecting the roll bar sections includes extending a driving member from one section into engagement with another section.

38. The method of assembling a retractable awning of claim 35 wherein each roll bar section includes an outer curved surface and wherein the step of connecting the roll bar sections includes confining a connecting structure to a position inwardly of the outer surfaces of the roll bar sections.

39. The method of claim 35 wherein one of the retractable and extendable arms is connected between one section of the frame structure and one section of the lead bar, and wherein the other retractable and extendable arm is connected between the other section of the frame structure and the other section of the lead bar.

* * * * *